US007168633B2

(12) United States Patent
Wang et al.

(10) Patent No.: US 7,168,633 B2
(45) Date of Patent: Jan. 30, 2007

(54) SPRAYING DEVICE

(75) Inventors: Yu-Ran Wang, Banqiao (TW); Chien-Shien Yeh, Yongkang (TW); Yi-Cheng Chen, Jhonghe (TW); Sheng-Chih Shen, Sinying (TW); Chi-Hsiung Teng, Sinjhuang (TW); Ming-Jye Tsai, Sinpu Township, Hsinchu County (TW)

(73) Assignee: Industrial Technology Research Institute, Hsinchu (TW)

( * ) Notice: Subject to any disclaimer, the term of this patent is extended or adjusted under 35 U.S.C. 154(b) by 20 days.

(21) Appl. No.: 11/165,113

(22) Filed: Jun. 22, 2005

(65) Prior Publication Data

US 2006/0226253 A1 Oct. 12, 2006

(51) Int. Cl.
*B05B 1/08* (2006.01)

(52) U.S. Cl. ..... 239/102.2; 239/102.2; 239/103; 123/498; 310/327; 310/328; 310/344; 310/340; 347/27

(58) Field of Classification Search ..... 239/102.1, 239/102.2, 103; 251/129.06; 310/326, 327, 310/328, 329, 340, 344, 345; 123/498; 347/23
See application file for complete search history.

(56) References Cited

U.S. PATENT DOCUMENTS 4,733,820 A * 3/1988 Endo et al. ..... 239/102.2
5,250,869 A * 10/1993 Ishikawa et al. ..... 310/334
5,457,353 A * 10/1995 Thurn et al. ..... 310/334
5,491,499 A * 2/1996 Bibbe et al. ..... 347/47
6,235,177 B1 * 5/2001 Borland et al. ..... 205/67
6,376,969 B1 * 4/2002 Forck ..... 310/346
6,550,472 B2 * 4/2003 Litherland et al. ..... 128/200.18
6,554,201 B2 * 4/2003 Klimowicz et al. ..... 239/4
6,789,741 B2 * 9/2004 Varanasi et al. ..... 239/102.1
6,860,436 B2 * 3/2005 Garcia et al. ..... 239/327
7,066,398 B2 * 6/2006 Borland et al. ..... 239/102.2
7,083,112 B2 * 8/2006 Ivri ..... 239/4
2004/0012306 A1 * 1/2004 Nishimura et al. ..... 310/327

* cited by examiner

*Primary Examiner*—David A. Scherbel
*Assistant Examiner*—Trevor McGraw
(74) *Attorney, Agent, or Firm*—Pro-Techtor Int'l Services

(57) ABSTRACT

A spraying device comprises a spraying plate, having a plurality of tiny holes, a vibrating element, set on a periphery of the spraying plate, and driving a vibrating movement thereof, a wrapping layer, made of soft material and tightly surrounding the vibrating element, sealing the vibrating element from the liquid, and a fastening cap, allowing for quick mounting and dismounting of the spraying device; wherein the vibrating movement of the spraying plate causes liquid adjacent to a lower side of the spraying plate to be periodically compressed and thereby to be pressed through the holes of the spraying plate, and wherein the wrapping layer prevents external interference with the vibrating movement, at the same time minimizing transmission losses of vibrational energy, enhancing effectivity of spraying.

8 Claims, 3 Drawing Sheets

SPRAYING DEVICE

BACKGROUND OF THE INVENTION

1. Field of the Invention

The present invention relates to a spraying device, particularly to a small spraying device which works by the piezoelectric effect.

2. Description of Related Art

Currently available small spraying devices mostly spray micro-particles by generating pressure variations, having a vibrating element and a spraying plate. Spraying plates are produced in two kinds, with the vibrating element being immersed in a liquid to be sprayed or connected with the spraying plate. When the voltage is applied to the vibrating element, a vibrating movement thereof ensues and is transmitted to the liquid to the spraying plate, so that liquid is pressed through tiny holes in the spraying plate and dispersed as micro-droplets.

Small spraying devices are used for various purposes, including burners, printer cartridges, perfume flasks and medical sprayers. To avoid contact of electrodes and electric circuits or with liquid that is possibly etching and potentially damaging piezoelectric material or needs to be kept pure, the vibrating element is usually kept separated from the liquid. Mostly, an insulating plate made of stainless steel is inserted between the vibrating element and the liquid, being glued to the vibrating element. Therefore, the liquid is driven indirectly by the vibrating plate, resulting in losses of vibrational energy, waste of energy and ineffective spraying.

Furthermore, conventional spraying devices are usually dismountable, so that upon a defect whole spraying devices have to be replaced, which is wasteful.

SUMMARY OF THE INVENTION

It is an object of the present invention to provide a spraying device in which the vibrating element and liquid to be sprayed are insulated from each other, so that more effective spraying and reduced energy consumption are achieved.

Another object of the present invention is to provide a spraying device which is easily dismountable by using clamps or threads.

The present invention can be more fully understood by reference to the following description and accompanying drawings.

DETAILED DESCRIPTION OF THE PREFERRED EMBODIMENTS

As shown in FIG. 1, the spraying device of the present invention mainly comprises a spraying plate 10 and a vibrating element 20. The spraying plate 10 is formed like a disc having a central part with a plurality of spraying holes 11 in a dense arrangement. Liquid passing through the spraying holes 11 emerges as a plurality of micro-droplets. The vibrating element 20 surrounds a periphery of the spraying plate 10 and is made of piezoelectric material. Applying the voltage to the vibrating element 20 generates vibrations thereof, which is transmitted to a vibrating movement of the spraying plate 10.

Referring to FIG. 2, the vibrating movement of the spraying plate 10 is performed in a direction perpendicular to the spraying plate 10, periodically compressing liquid 13 (as shown in FIG. 3A) adjacent to a lower side of the spraying plate 10, causing liquid 13 to be driven through the spraying holes 11, which define diameters and spraying directions of emerging micro-droplets 12 and ensure homogeneity thereof. As shown in FIG. 3B, when the spraying plate 10 moves away from the liquid 13, liquid 13 is sucked into adjacent space thus created.

The main characteristic of the present invention is a wrapping layer 30, insulating the vibrating element 20 from the liquid 13. The wrapping layer 30 is made of silicone rubber or another suitable soft material, tightly surrounding the vibrating element 20 and contacting the periphery of the spraying plate 10, so that the liquid 13 will not contact the vibrating element 10 and damaging thereof by the liquid 13 as well as polluting of the liquid will be prevented.

Besides isolating the liquid 13 from the vibrating element 20, the wrapping layer 30, being made of soft material, attenuates any external interference with the vibrating element 20. On the other hand, losses of vibrational energy are minimized due to direct transmitting thereof from the vibrating element 20 to the spraying plate 10.

Referring to FIG. 4, the present invention further has a fastening cap 40, which serves to fasten the spraying plate 10, the vibrating element 20 and the wrapping layer 30 on a neck 51 of a container 50, with an opening of the neck 51 defining an upper side.

The fastening cap 40 has a cylinder 41, which is put over the neck 51 of the container 50, having a diameter that is larger than the width of the spraying plate 10 and the wrapping layer 30 when assembled, allowing to place the spraying plate 10, the vibrating element 20 and the wrapping layer 30 thereon. A shoulder 42 reaches from an upper end of the cylinder 41 inward, pressing from above on a peripheral projection 31 of the wrapping layer 30, thereby pressing the wrapping layer 30 on the neck 51.

The cylinder 41 has a lower end with a holding part 43, which is shaped like an inward pointing hook, engaging with an incision 52 on the periphery of the container 50.

Referring to FIG. 5, in a second embodiment of the present invention, the cylinder 41 has an inner side with an inner thread 44 and the container 50 close to the neck 51 has a periphery with an outer thread 53, allowing to screw the fastening cap 40 on the container 50.

Since the fastening cap 40 provides for easy fastening of the spraying plate 10, the vibrating element 20 and the wrapping layer 30 on the neck 51 of the container 50, damaging of one of the structural parts of the spraying device of the present invention does not require replacing of the entire spraying device, avoiding waste and saving cost.

Furthermore, easy dismounting and remounting of the fastening cap 40 allows for quick adaption to different standards and requirements, including different diameters of sprayed micro-droplets and different rates of outflow of liquid, which are met by mounting another spraying plate 10 with a different number of spraying holes 11 of different diameters.

Figure 1:
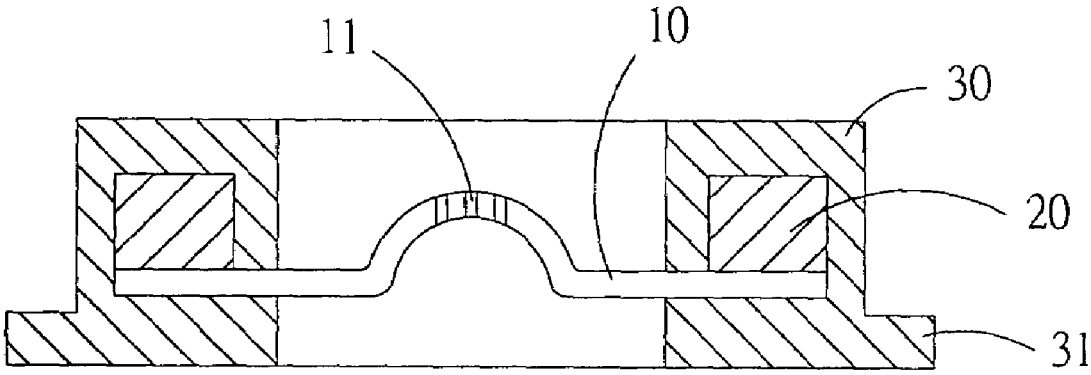
FIG. 1 is a sectional side view of the spraying plate, the vibrating element and the wrapping layer of the present invention.
Figure 2:
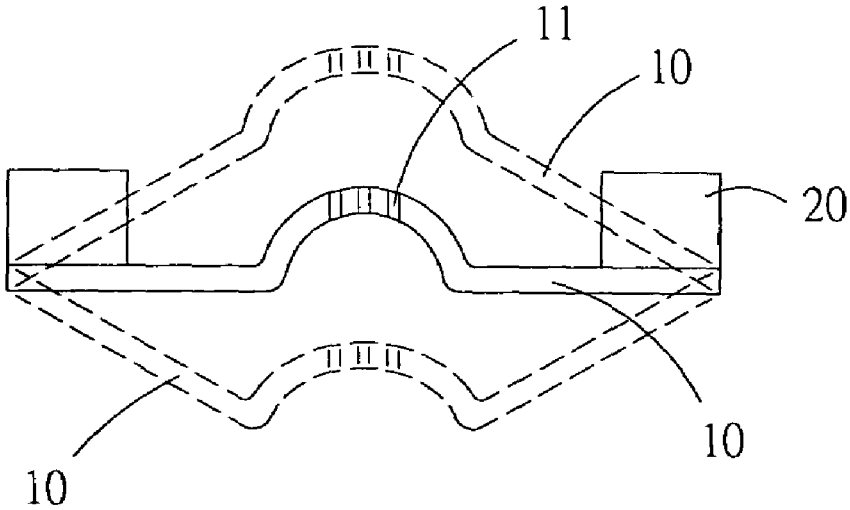
FIG. 2 is a sectional side view of the spraying plate and the vibrating element of the present invention during operation.
Figure 3A:
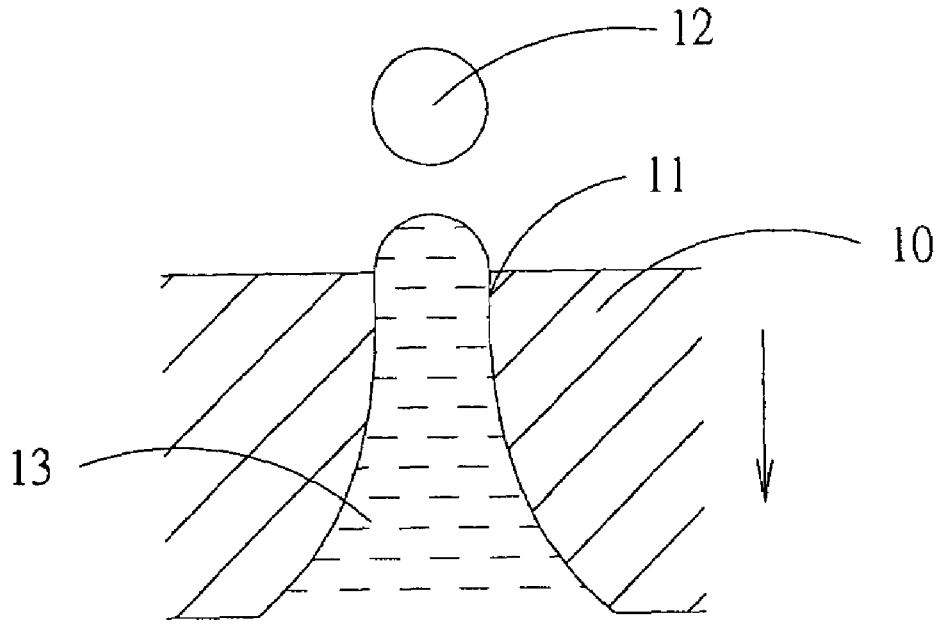
FIGS. 3A and 3B are schematic illustrations of one of the spraying holes passed through by liquid.
Figure 3B:
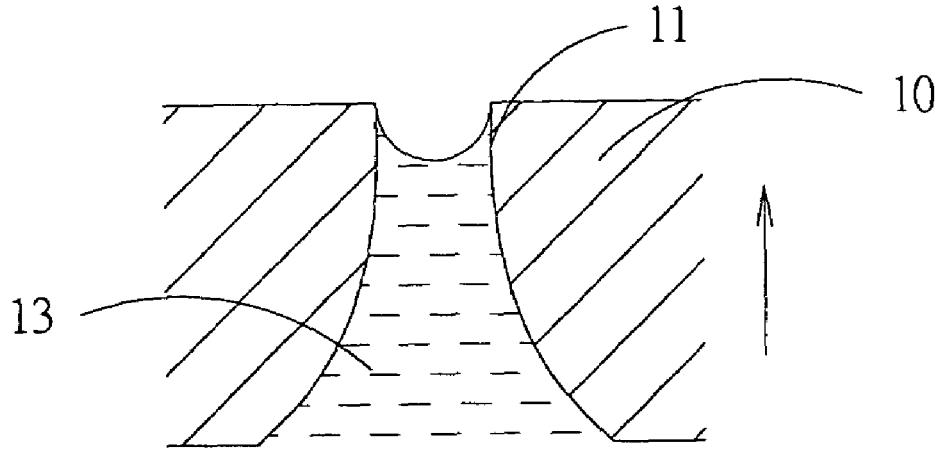
Figure 4:
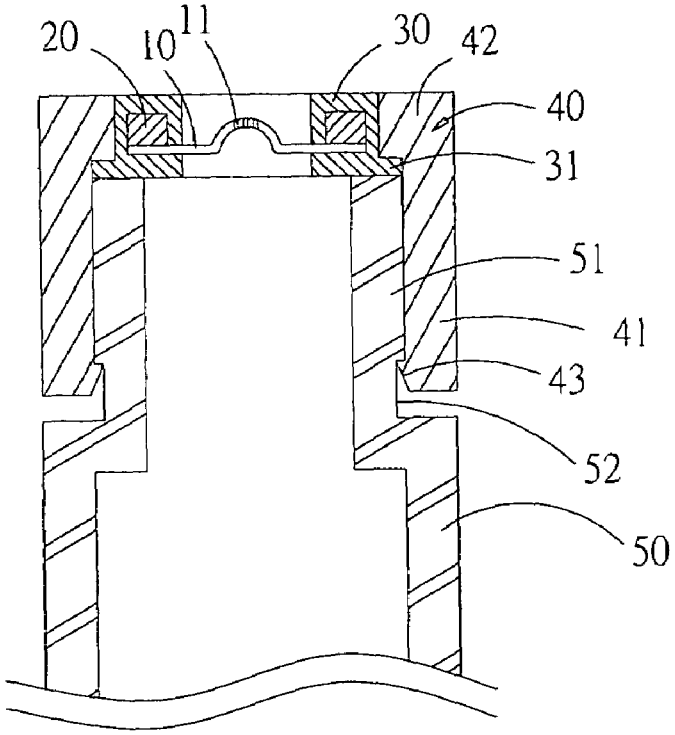
FIG. 4 is a sectional side view of the present invention in the first embodiment.
Figure 5:
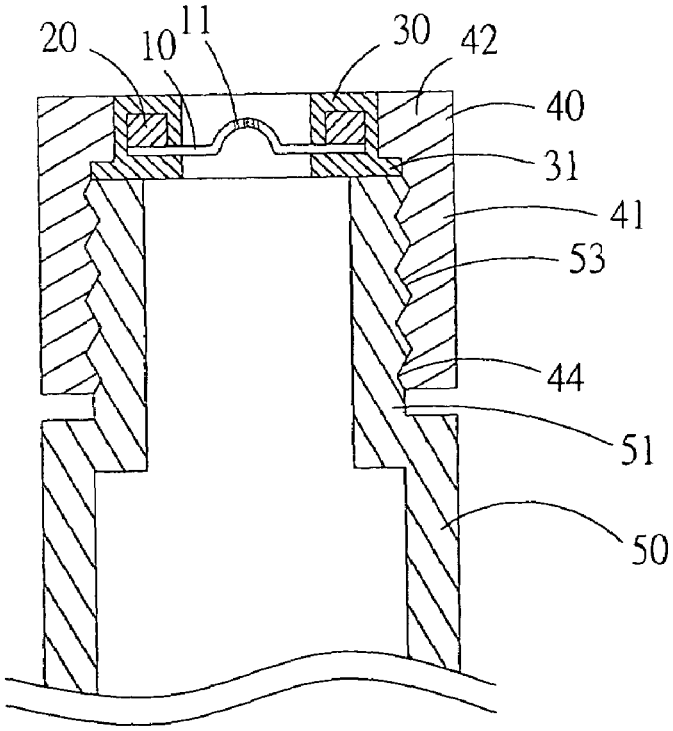
FIG. 5 is a sectional side view of the present invention in the second embodiment.

The invention claimed is:

1. A spraying device, comprising:

a spraying plate, having a plurality of tiny holes;

a vibrating element, shaped like a ring, attached to a periphery of said spraying plate, and driving a vibrating movement thereof, which causes liquid adjacent to a lower side of said spraying plate to be periodically compressed and thereby to be pressed through said holes of said spraying plate;

a wrapping layer, made of soft material and tightly surrounding said vibrating element, sealing said vibrating element from said liquid, preventing external interference with said vibrating movement, at the same time minimizing transmission losses of vibrational energy, enhancing effectivity of spraying; and a fastening cap, allowing for quick mounting and dismounting of said spraying device.

2. The spraying device according to claim 1, wherein said wrapping layer is made of silicone rubber.

3. The spraying device according to claim 1, wherein said wrapping layer surrounds said vibrating element and said periphery of said spraying plate, contacting part of said vibrating element.

4. The spraying device according to claim 1, wherein said fastening cap fastens said spraying plate, said vibrating element and said wrapping layer on a neck of a container.

5. The spraying device according to claim 4, wherein said fastening cap comprises a cylinder with an upper end and a lower end, a shoulder, reaching from said upper end of said cylinder inward, engaging with said wrapping layer, so that said spraying plate, said vibrating element and said wrapping layer are held on said neck of said container.

6. The spraying device according to claim 5, wherein said wrapping layer has an outward reaching peripheral projection with which said shoulder of said fastening cap engages.

7. The spraying device according to claim 5, wherein said fastening cap further comprises a holding part at a lower end of said cylinder, which is shaped like an inward pointing hook, engaging with an incision on a periphery of said container.

8. The spraying device according to claim 5, wherein said cylinder of said fastening cap has an inner side with an inner thread, allowing to engage said fastening cap with an outer thread on said neck of said container.

* * * * *